US005699092A

United States Patent [19]

Kawakami et al.

[11] Patent Number: 5,699,092

[45] Date of Patent: Dec. 16, 1997

[54] INK-JET RECORDING DEVICE

[75] Inventors: Kazuhisa Kawakami; Katsuhiko Iida; Narihiro Oki; Shigenori Fukasawa; Nobuhito Takahashi, all of Nagano, Japan

[73] Assignee: Seiko Epson Corporation, Tokyo, Japan

[21] Appl. No.: 82,379

[22] Filed: Jun. 28, 1993

[30] Foreign Application Priority Data

Jun. 26, 1992 [JP] Japan ..... HEI4-193403

[51] Int. Cl.[6] ..... B41J 2/165

[52] U.S. Cl. ..... 347/30; 347/32; 347/33; 347/36

[58] Field of Search ..... 347/29, 30, 32, 347/33, 36; 417/476

[56] References Cited

U.S. PATENT DOCUMENTS

| | | | |
|---|---|---|---|
| 4,825,231 | 4/1989 | Nozaki | 346/140 R |
| 4,853,717 | 8/1989 | Harmon et al. | 347/29 |
| 4,906,168 | 3/1990 | Thompson | 417/476 X |
| 5,126,764 | 6/1992 | Miyauchi et al. . | |
| 5,132,711 | 7/1992 | Shinada et al. . | |
| 5,138,343 | 8/1992 | Aichi et al. | 347/30 |
| 5,153,613 | 10/1992 | Yamaguchi et al. | 347/30 |
| 5,153,614 | 10/1992 | Yamaguchi et al. . | |
| 5,155,497 | 10/1992 | Martin et al. | 347/33 |
| 5,172,140 | 12/1992 | Hirabayashi et al. . | |
| 5,260,724 | 11/1993 | Tomii et al. | 347/32 |
| 5,266,975 | 11/1993 | Mochizuki et al. | 347/30 X |
| 5,332,969 | 7/1994 | Mochizuki et al. . | |
| 5,394,178 | 2/1995 | Grange | 347/32 |
| 5,398,054 | 3/1995 | Fukazawa et al. | 347/33 |

FOREIGN PATENT DOCUMENTS

| | | |
|---|---|---|
| 0313204 | 12/1988 | European Pat. Off. . |
| 0409558 | 7/1990 | European Pat. Off. . |
| 0442439 | 2/1991 | European Pat. Off. . |
| 0446885 | 3/1991 | European Pat. Off. . |
| 0449324 | 3/1991 | European Pat. Off. . |
| 0440110 | 8/1991 | European Pat. Off. . |
| 0442470 | 8/1991 | European Pat. Off. . |
| 0452119 | 10/1991 | European Pat. Off. . |
| 0480473 | 10/1991 | European Pat. Off. . |
| 0495669 | 7/1992 | European Pat. Off. . |
| 0540174 | 5/1993 | European Pat. Off. . |
| 0552472 | 7/1993 | European Pat. Off. . |
| 3224549 | 11/1985 | Japan . |
| 3224955 | 9/1988 | Japan . |

*Primary Examiner*—Huan H. Tran

*Attorney, Agent, or Firm*—Sughrue, Mion, Zinn, Macpeak & Seas, PLLC

[57] ABSTRACT

An ink-jet recording device in which a capping device a and cleaning device can be made as compact as possible. The ink-jet recording device includes a capping device which is disposed out of a printing area and, when pushed by a recording head or a carriage carrying the recording head, can be moved between a non-capping position and a capping position, a cam surface and a cam follower which, in a process where the recording head is moved from the non-capping position to the capping position, shift the capping device to the nozzle surface of the recording head, a cleaning device which is swingably mounted to the capping device by device of shafts and is movable between a non-cleaning position and a cleaning position in accordance with the movement of the recording head, and a suction pump which supplies a negative pressure to the capping device to thereby suck out ink within a cap member into a waste ink tank. In the ink-jet recording device, the capping device and cleaning device can be selectively moved to and from a recording head moving path only by device of the movement of the carriage.

21 Claims, 10 Drawing Sheets

INK-JET RECORDING DEVICE

BACKGROUND OF THE INVENTION

1. Field of the invention

The present invention relates to an ink-jet recording device which includes a recording head movable in the width direction of recording paper and which expels ink droplets onto the recording paper to form an image thereon and, in particular, an ink-jet recording device which includes capping means and cleaning means for maintaining the ink expelling ability of the recording head.

2. Prior Art

Conventionally, there is known an ink-jet recording device which expels ink, which is pressurized in a pressure chamber, onto recording paper as ink droplets to thereby record print data. In the conventional ink-jet recording device, ink solvent easily evaporates from a nozzle opening, which increases the viscosity of the ink and causes the ink to dry. Also, dust can be easily attached to the ink, and air bubbles can be mixed into the ink. For these reasons, printing quality can be poor in the conventional ink-jet recording device. To cope with this problem, the ink-jet recording device of this type includes capping means for sealing the nozzle opening during the non-printing time and cleaning means for cleaning the vicinity of the nozzle opening an demand.

Unexamined Japanese Patent Publication Hei No. 1-125239 discloses a device, having a capping means, in which a sled to be pushed and moved by a carriage in a home position is moved along an inclined guide surface in a frame to the nozzle opening surface of a recording head, and a cap formed of an elastic member provided on the surface of the sled is pushed against the recording head to thereby seal the opening of the nozzle.

Also, Examined Japanese Patent Publication Hei No. 2-13910 of Heisei discloses means for pressing a cap against a recording head, in which two arms forming a parallelogram are interposed between a frame and the cap, and the cap is moved by a carriage in the horizontal direction and also in the direction of the recording head, that is, in the vertical direction.

In the above-mentioned conventional devices, since the amount of movement in the vertical direction is defined by an inclined guide surface on the frame and by the parallelogram link, when the distance between the running path of the carriage and the frame varies somewhat due to error the working of parts or in assembling thereof, or when the distance between a platen and the recording head is re-adjusted so as to print an image on thick recording paper such as an envelope, the distance between the recording head and the cap varies so that an operation to seal a nozzle opening depends on the elastic deformation of the cap itself. This is not a problem when the sealing surface is small but, when a recording head includes a large number of nozzles, it is very difficult to seal the whole surface thereof equally.

Unexamined Japanese Patent Publication Sho No. 59-103762 discloses an inverted-L-shaped head protect which is supported in a home position in such a manner that it is rotatable, the protect cover rotated by a carriage which has moved to the home position, thereby pressing a cap provided at one end of the protect cover against a recording head.

Since the amount of rotation of the protect cover varies according to the distance to the nozzle surface, this device can provide a positive sealing effect even on a recording device in which the distance between a platen and a printing head is adjustable. However, due to the fact that the direction of movement of the recording head is different from the direction of the movement of the cap, the relative movements produced between the recording head and cap cause the cap to be deformed unnecessarily, which facilitates the breakage or damage of the cap.

Unexamined Japanese Patent Publication Hei No. 2-518 discloses cleaning means, in which a cleaning member, which is used to rub the nozzle surface of a recording head in two kinds of modes, is disposed in the vicinity of a cap device in such a manner that it can be advanced and retreated toward and away from the recording head.

SUMMARY OF THE INVENTION

According to the conventional devices described above, it is possible to clean the nozzle surface according to the contaminated conditions thereof However, a drive mechanism is required to advance and retract the cleaning member along the moving path of the recording head.

In view of the forgoing problems, it is an object of the present invention to provide an ink-jet recording device in which a capping operation and the advance and retreat of a cleaning member are executed by the movement of a carriage to thereby be able to provide a compact ink expelling ability maintaining and recovering means.

In order to achieve the above object, according to the invention, there is provided an ink-jet recording device which comprises cap support means disposed out of a printing area and pressed by a carriage to move between a non-capping position and a capping position, shift means for shifting the cap support means to the nozzle surface of a recording head in a process of the recording head moving from the non-capping position to the capping position, cleaning material support means for moving between a non-cleaning position and a cleaning position by the movement of the carriage, the cleaning material support means being movably mounted to the cap support means, and suction means for supplying a negative pressure to the cap means to thereby suck ink from the cap into a waste ink tank.

If the recording head moves to a position out of the printing area, then the capping support means moves to the side of the recording head to bring a cap member into elastic contact with the front surface of the recording head. Also, if the moving mode of the recording head is changed, then the cleaning member support member is moved in a recording head moving path to thereby contact the recording head. In this condition, by advancing or returning the recording head, the recording head can be rubbed with different cleaning members to thereby remove dust and other foreign matters from the recording head.

BRIEF DESCRIPTION OF THE DRAWINGS

FIG. 3 (*b*) is a schematic view of the above device with a capping device as the center thereof, which shows a state in which the recording head exists in a wait position;

FIG. 4 (*b*) is a view of an embodiment of a cap member forming a part of the capping device, which shows a view of the section thereof perpendicular to the recording head moving path;

DETAILED DESCRIPTION OF THE PREFERRED EMBODIMENTS

Description will be given hereinbelow of the details of the invention by way of the embodiments illustrated in the accompanying drawings.

Figure 1:
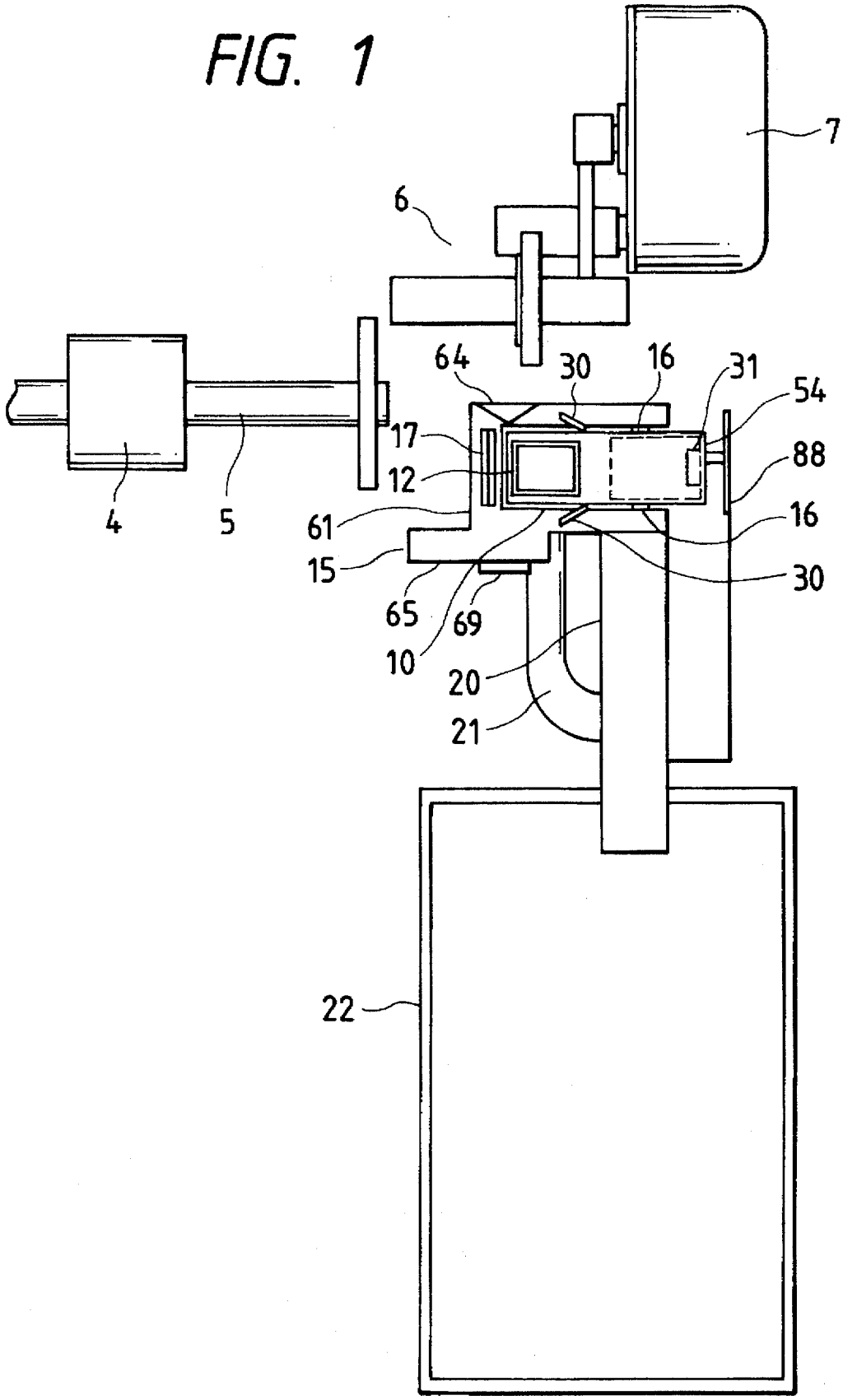
FIG. 1 is a top plan view of an embodiment of an ink-jet recording device according to the invention.
Figure 2:
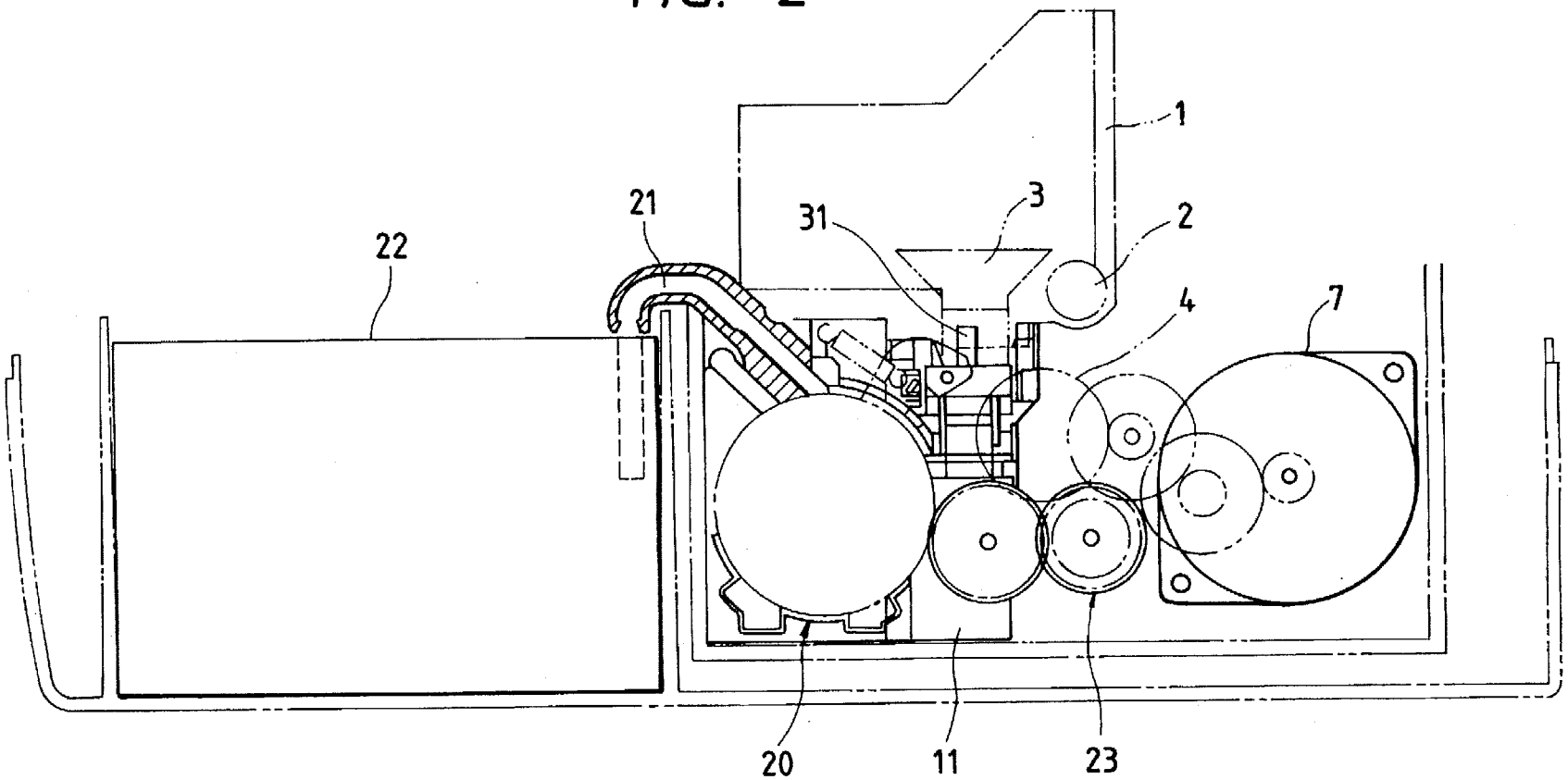
FIG. 2 is a side view of an embodiment of an ink-jet recording device according to the invention.

FIGS. 1 and 2 are respectively a top plan view and a side view of an ink-jet recording device according to the invention. In these figures, reference numeral 1 (FIG. 1) designates a carriage which is supported by a guide shaft 2 and is allowed to reciprocate in the width direction of recording paper when it is driven by a pulse motor (not shown). The carriage 1 carries therein a recording head 3 for expelling ink droplets in such a manner that, in the present embodiment, the nozzle opening of the recording head faces downward. The carriage 1 also includes in its printing area outer end portion a flag piece la which can be selectively contacted with a remove piece 64 and an engagement piece 31 to be described later. A paper feed roller 4 is supported by a drive shaft 5 and is connected through a ring array 6 to a paper feed motor 7.

A capping device 10 is disposed out of the printing area and is mounted on a base member 11, so as to be capable of moving between a capping position and a non-capping position in accordance with the movement of the recording head 3, as will be described later. The capping device 10 includes on its printing area a cap member 12 and, on its outer side, a valve mechanism 14 (see FIGS. 3(*a*), 3(*b*)) which communicates the cap member 12 with an air release port 13. A cleaning member 17 is composed of a rubber plate 17*a* suitable for a wiping operation and a sponge member 17*b* suitable for a rubbing operation. They are bonded to each other in such a manner that the rubber plate 17*a* is disposed on the outer side and the sponge member 17*b* is situated on the printing area side.

A cleaning device 15 is movably mounted to shafts 16, 16 respectively provided on the two sides of the capping device 10. Similarly to the capping device 10, the cleaning device 15 moves between a cleaning position and a non-cleaning position in accordance with the movement of the recording head 3, and the cleaning, member 17 formed of an elastic plate material is fixed to the leading end side or printing area side of the cleaning device 15. A suction pump 20 communicates with the cap member 12 and a waste ink tank 22 by means of a tube 21 forming a part of the pump and also which is connected to the paper feed motor 7 through a ring array 23.

Figure 3A:
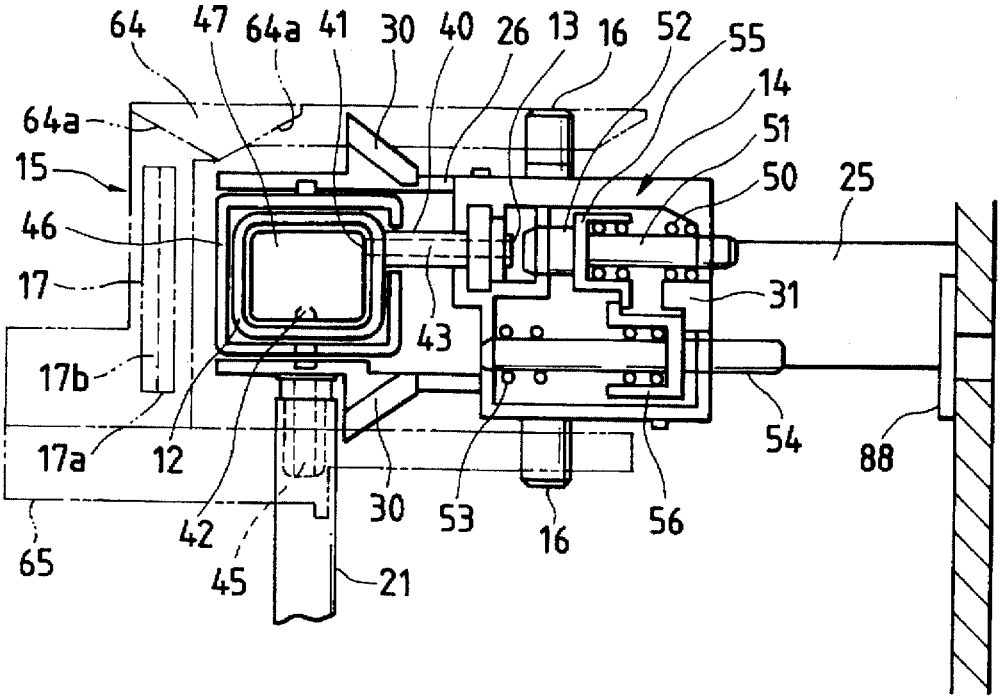
FIG. 3 (*a*) is a schematic view of the above device with a capping device as the center thereof, which shows a state in which a recording head exists in a printing area.
Figure 3B:
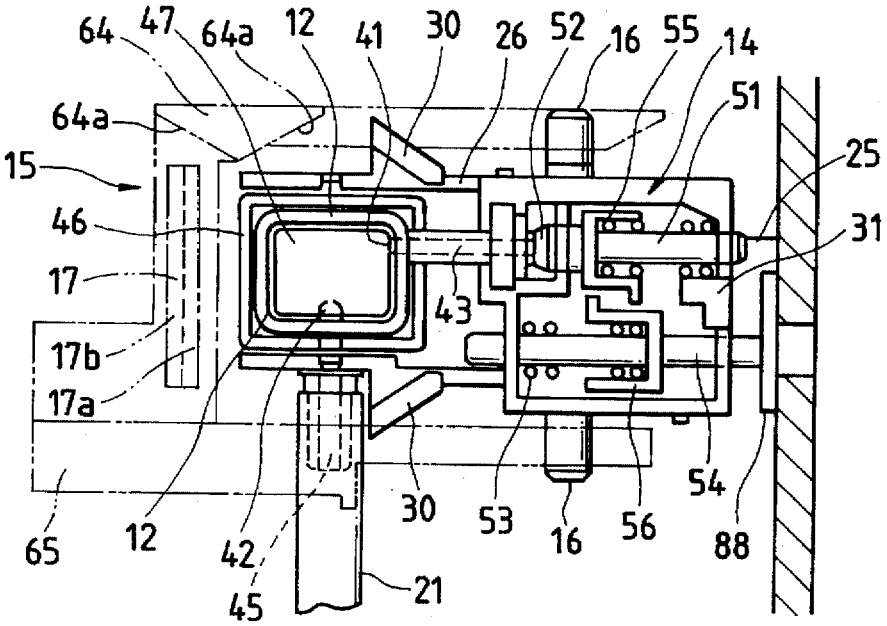
Figure 9A:
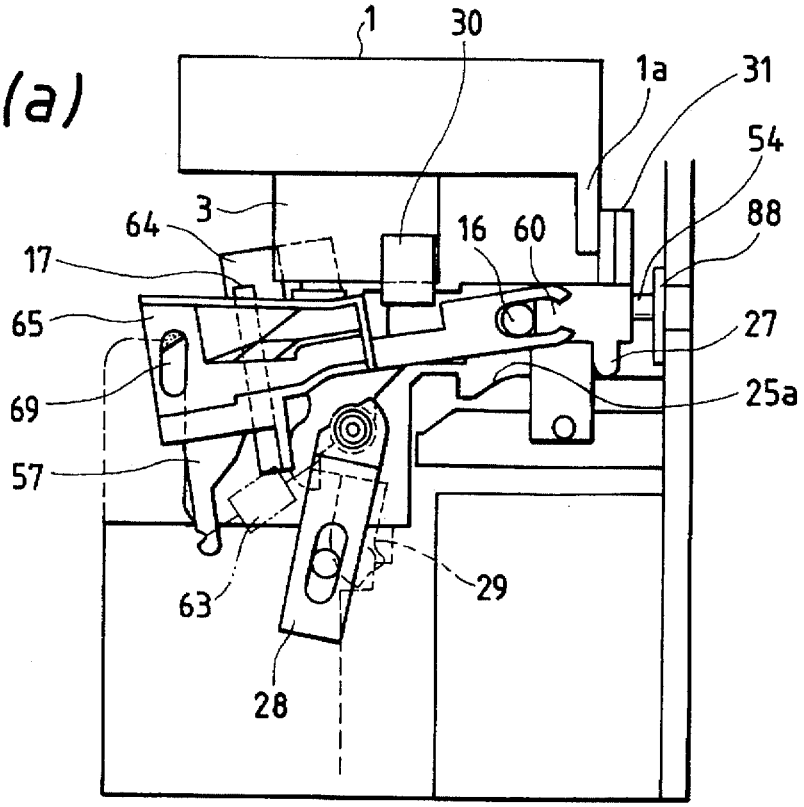
FIGS. 9 (*a*) and (*b*) are respectively explanatory views of the operations of the above devices.
Figure 9B:
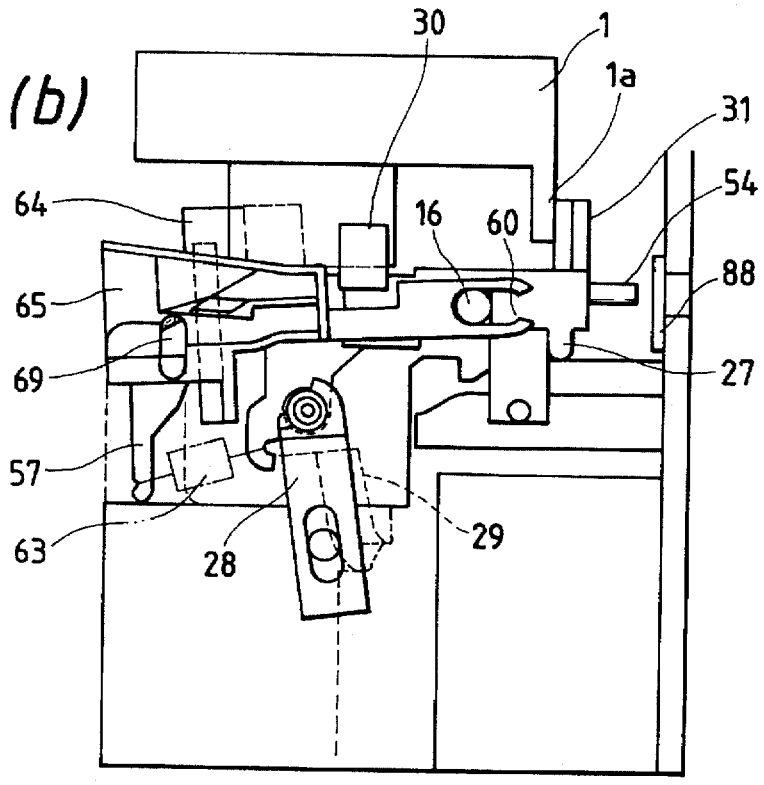
Figure 10A:
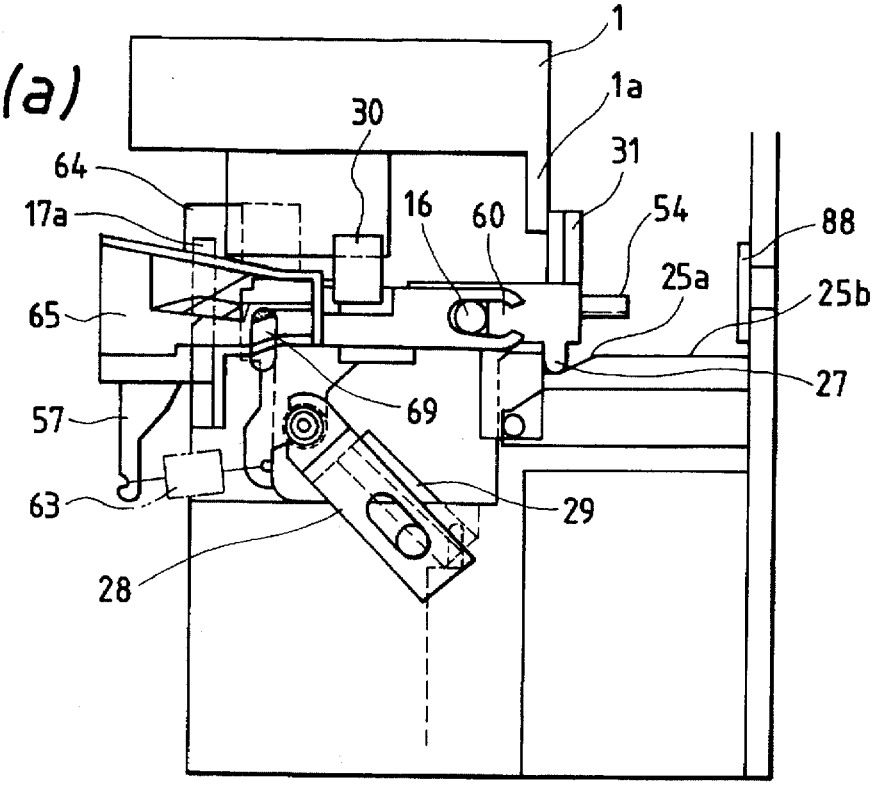
FIGS. 10 (*a*) and (*b*) are respectively explanatory views of the operations of the above devices.
Figure 10B:
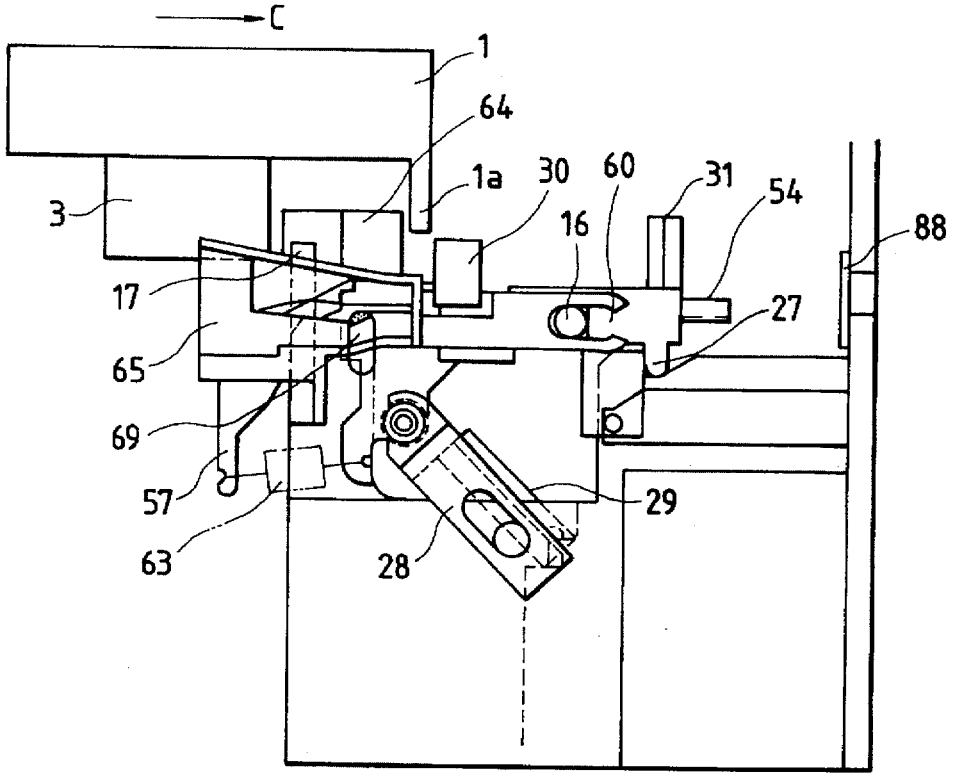

FIGS. 3 (*a*) and (*b*) are views of the above embodiment of the invention in which the capping device 10 is shown as the center of the embodiment. In particular, FIG. 3 (*a*) illustrates a state in which the recording head 3 exists in the printing area, while FIG. 3 (*b*) illustrates a state in which the recording head 3 exists in the home position. In this structure, the cap member 12 is provided on a slider 26 which is movable in the moving direction of the recording head 3 in parallel to a base member 25 and is also movable in the vertical direction. The slider 26 includes a projection 27 (see FIG. 4 (*a*)) provided on the lower surface thereof, which projection 27 is movable along the base member 25 as its slidable surface. The projection 27 is also energized in two directions, that is, in the upward direction and in the direction of the printing area by a bending spring 29 (see FIGS. 9 (*a*, 9 (*b*)) disposed on the printing area side. The bending spring 29 is mounted on a link 28 provided on the base member 25 and is placed between the link 28 and base member 25. The surface to be slided by the projection 27 of the slider includes an inclined surface 25*a* with the printing area side as the bottom and a plane 25*b* (see FIG. 10 (*a*)) disposed at a height to push the cap member 12 against the recording head 3 when the recording head 3 reaches the home position. Also, the slider 26 includes in the two sides thereof guides 30, 30 respectively spread out toward the printing area to the width of the recording head 3, and in the outer end portion thereof an engagement piece 31 to be contacted by a flag piece la of the carriage 1 (as shown in FIG. 10 (*a*)).

The cap member 12 is constructed in the form of an elastic cup which includes in the upper surface thereof an air intake port 41 in communication with the air release port 13 through a piece 40 and a suction port 42 to which a negative pressure from the pump 20 is applied. The air intake port 41 is connected to the air release port 13 by a pipe conduit 43, while the suction port 42 is connected to the pump tube 21 by a pipe conduit 44. The pipe conduits 43 and 44 are formed by injection molding so that they can be integral with the elastic cup. In the leading end portion where the air release port 13 is formed, there is formed a valve seat portion in such a manner that it can be closed by a valve body 52 to be described later. Also, a tube forming the other pipe conduit 44 is connected to the pump tube 21 by means of a connecting through hole 45 formed in the slider 26. This structure allows the frame body 61 (described later) to receive a reaction force generated from a tube 21 with the movement of the recording head 3, which prevents a useless force from acting on the slider 28 and cap member 12 and prevents the slider 26 and cap member 12 from being shifted.

Figure 4A:
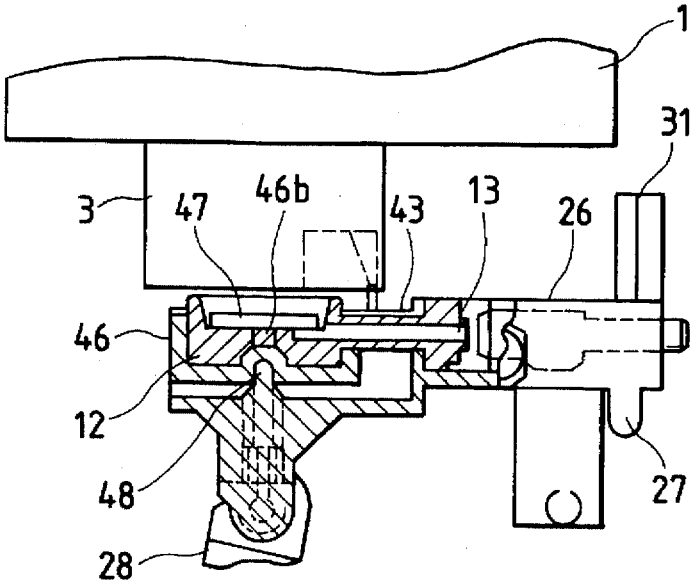
FIG. 4 (*a*) is a view of an embodiment of a cap member forming a part of the capping device, which shows a view of a section of the cap member parallel to the moving path of a recording head.
Figure 4B:
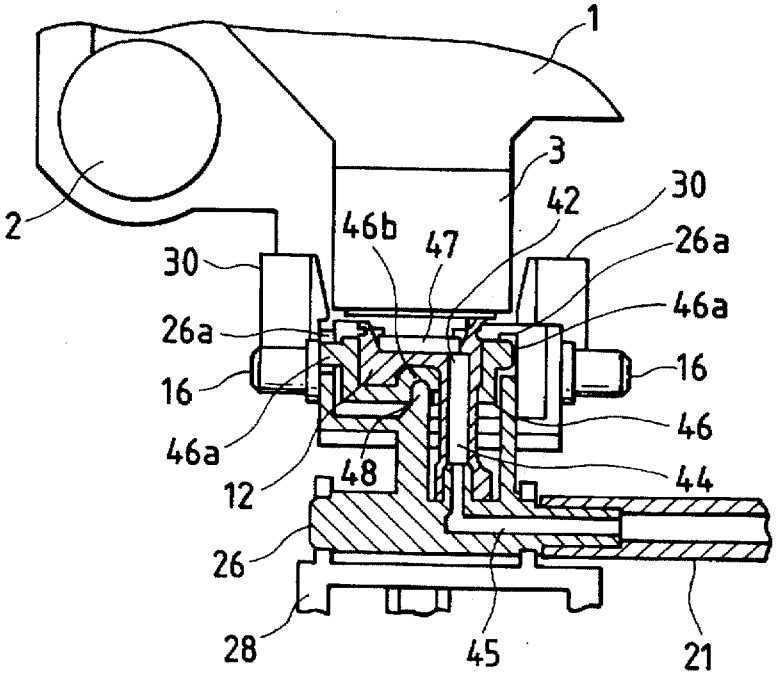

The cap member 12, as shown in FIG. 4, is stored in a receive member 46 formed of a highly rigid material such as macromolecule and the like so that a part of the edge of the cap member 12 forming the opening thereof can be exposed. Also, the cap member 12 stores therein an ink absorber 47 formed of a porous material which can absorb ink. The receive member 46 includes in the upper portion thereof two arms 46*a*, 46*a* respectively extending perpendicularly to the moving direction of the recording head 3 and in the bottom portion thereof a hemispherical recessed portion 46*b*. The upper portion of the cap member 12 is loosely fitted with the slider 26 by means of the two arms 46*a*, 46*a*, while the bottom portion thereof is loosely fitted into a hemispherical projection 48 projecting out from the slider 26. Due to this, regardless of the attitude of the recording head 3, the cap member 11 can be tightly contacted with the front surface of the recording head 3.

Referring back again to FIGS. 3 (*a*), 3 (*b*), the capping device 10 includes the above-mentioned valve mechanism which includes a valve body 52 disposed opposed to the air release port 13 and mounted to one end of a guide rod 51 always energized toward the air release port 13 by a spring 50, a drive rod 54 energized outwardly by a spring 53 stronger than the spring 50 in such a manner that the opposite side portion thereof to the printing area is always projected out from the cap member 12, and engagement pieces 55, 56 respectively for engaging the guide rod 51 with the drive rod 54. In the valve mechanism 14, when the drive rod 54 is pushed by the movement of the recording head 3 into a condition shown in FIG. 3 (*b*), then the valve body 52 loses its braking force and thus it is abutted against the air release port 13 only by the energization force of the spring 50.

FIGS. 3 (*a*), 3 (*b*) shows a cleaning device 15 which includes the cleaning member 17. More particularly, the cleaning member 17 is disposed in a frame body 61 (see FIG. 7) which is supported in such a manner that an elongated groove 60 (as shown in FIG. 9) formed in one surface thereof and a round hole (not shown) formed in the other surface thereof are loosely fitted over the shafts 16, 16 respectively provided on the two sides of the slider 26 supporting the cap member 12 and also which is swingable about the round hole in the vertical direction as well as in a direction perpendicular to the moving direction of the recording head 3.

The frame body 61 includes a projection 57 which extends downwardly nearer to the center of the leading end portion of the printing side thereof and also which is always energized downwardly toward the printing area by a tension spring 63 provided between the slider 26 and itself. Also, the frame body 61 includes a remove piece 64 and cam surface 65 which are formed respectively on the two sides thereof facing each other with the moving path of the recording head between them. The remove piece 64 is formed in a triangle which has a recording head passing side as a vertex. When the inclined surfaces 64*a*, (see FIG. 3 (*b*)) 64*a* facing each other with the vertex between them contact the flag piece 1*a* of the carriage 1, then the frame body 61 is caused to swing in a horizontal direction to thereby remove the engagement between the cam surface 65 and a cam follower 69 to be described later. The height of the remove piece 64 is selected to be higher than the guides 30, 30 of the slider 26 to thereby prevent the flag piece 1*a* of the carriage 1 from contacting the guides 30, 30.

Figure 5:
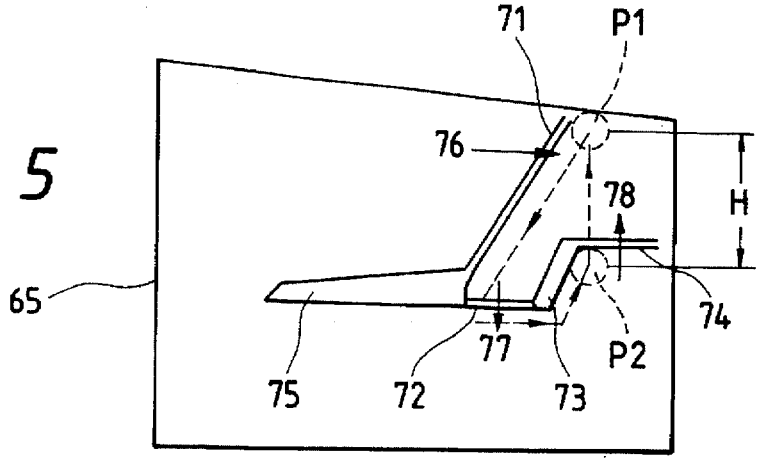
FIG. 5 is view of an embodiment of a cam surface of a cleaning device employed in the invention.

FIG. 5 shows an embodiment of the above-mentioned cam surface which includes a first inclined surface 71 forming a first path which is used to guide the frame body 61 upwardly when it is pushed by the carriage 1 in a direction going out of the printing area from a stable point P1 at which it contacts the carriage 1 while the carriage 1 is put in its non-contact condition, a second inclined surface 72 forming a second path which extends from the lower end of the first inclined surface 71 horizontally in a direction extending toward outside the printing area, a third inclined surface 73 forming a third path which is used to raise the frame body 61 to a cleaning position, a fourth inclined surface 74 used to hold the frame body 61 at the cleaning position, and a fifth inclined surface 75 for guiding a cam follower 69 to the first inclined surface 71.

The above-mentioned first and second inclined surfaces 71 and 72 respectively have a section of a right-angled triangle so that the frame body 61 can get over them when it is moved in the directions shown by arrows 76 and 77. Also, the fourth inclined surface 74 has a height selected so that the cam follower 69 can get over it when the frame body 61 is swung. The stable point P1 is set at a position where the cleaning member 17 is not in contact with the nozzle surface of the recording head, while a quasi-stable point P2 is set at a position having a level difference H from the stable point P1 so that the cleaning member 17 can contact the nozzle front surface of the recording head at the quasi-stable point P2.

Figure 6:
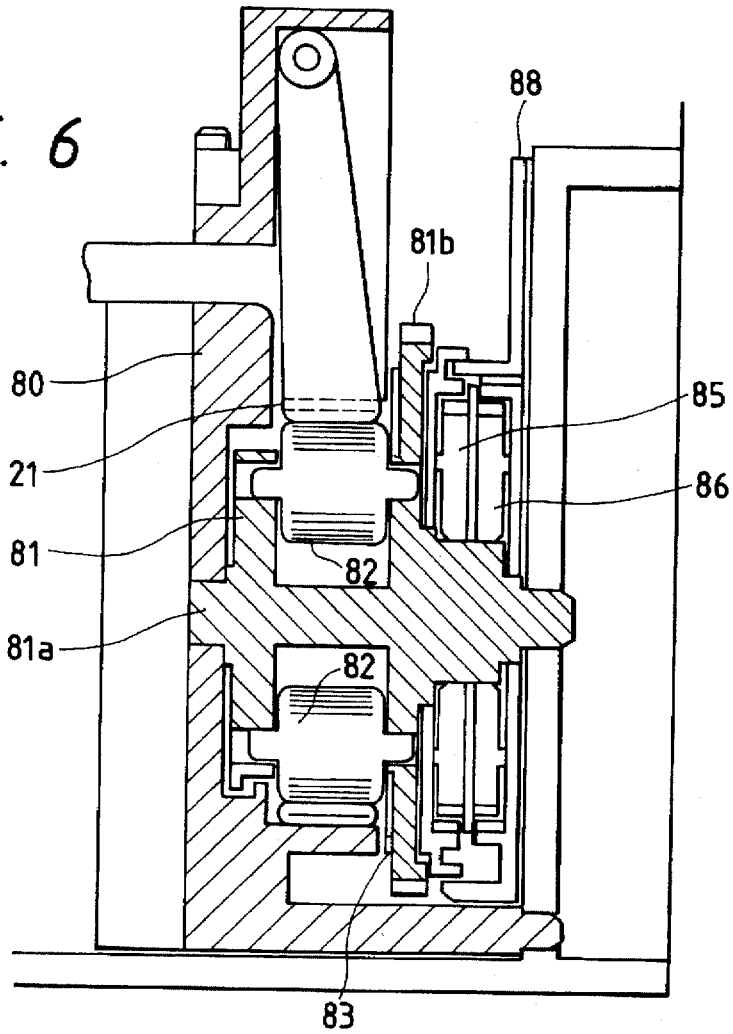
FIG. 6 is a section view of an embodiment of a suction pump employed in the invention.
Figure 7:
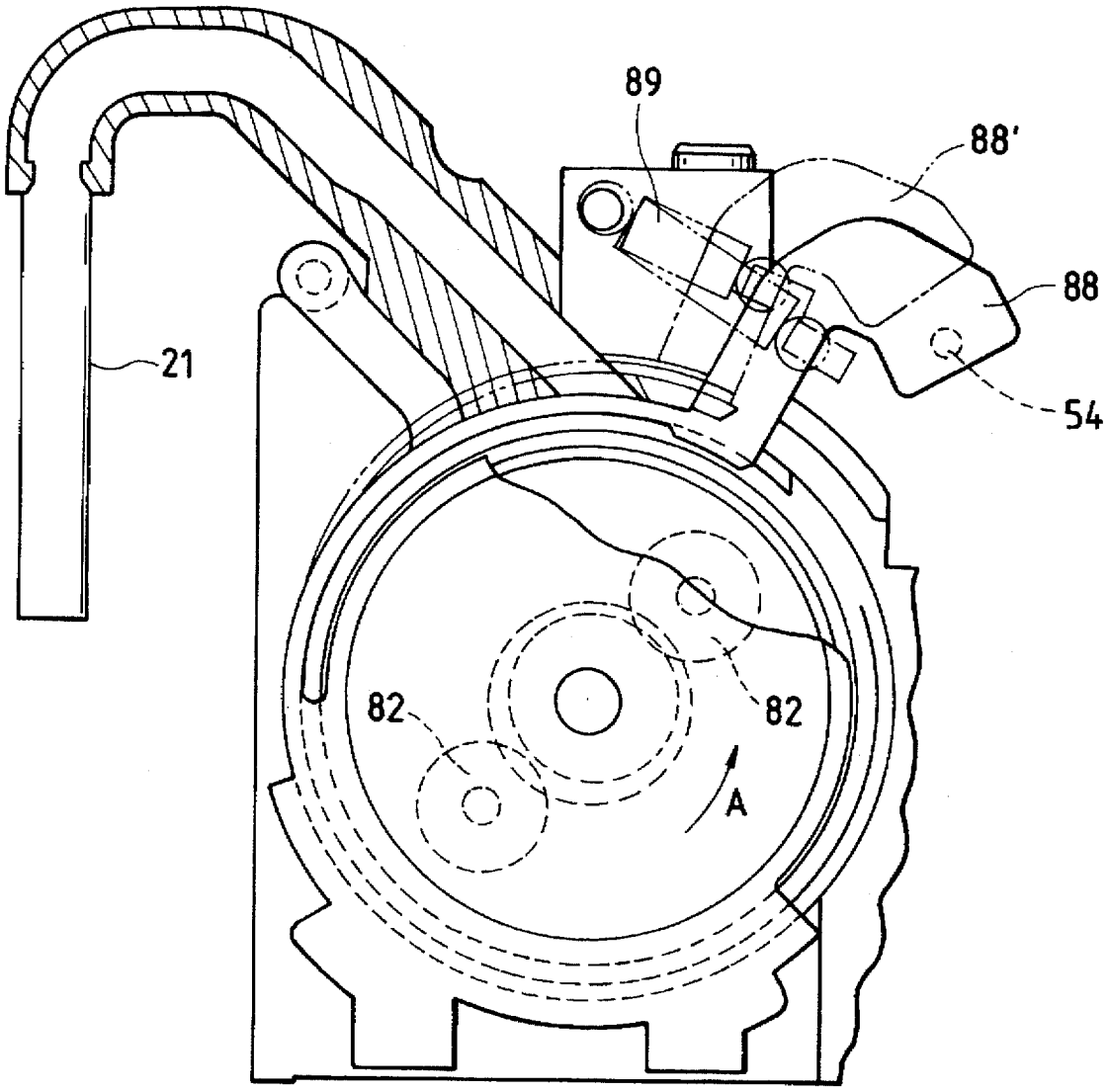
FIG. 7 is a side view of the above suction pump.

FIG. 6 shows an embodiment of the above-mentioned suction pump 20. In this embodiment, the suction pump 20 is constructed as a so called peristaltic pump in which the outside of the pump tube 21 connecting the cap member 12 with the waste ink tank 22 is held by a case 80 in such a manner that the pump tube outside can be almost circular, and the inner peripheral surface thereof is elastically pressed by two rollers 82, 82 respectively mounted rotatably to a drive panel 81 in such a manner that a rotary shaft 81*a* is put between the two rollers 82. The two rollers 82, 82, as shown in FIG. 7, are mounted to the drive panel 81 in such a manner that they are loosely fitted into elongated grooves (not shown) whose distances from the center thereof vary gradually. When the paper feed motor 7 is rotated forwardly, then the rollers 82, 82 are moved toward the tube 21, that is, toward the outer peripheral side of the drive panel to take positions to be able to press against the tube 21. On the other hand, when the paper feed motor 7 is rotated inversely for paper feed, then the rollers are moved toward the center of the drive panel to take positions to be able to cut off contact with the tube 21.

In the portion of the drive panel 81 that faces the tube 21, there is mounted a plate member 83 having a small coefficient of friction, which is formed of macromolecule mixed with a lubricant such as molybdenum or the like. The plate member 83 is used to reduce friction between the drive panel 81 and tube 21. The drive panel 81 includes in the outer periphery thereof a gear 81*c* which is connected to the paper feed motor 7 through a ring array 23. 85, 86 respectively designate differential gears mounted eccentrically on the shaft of the drive panel 81 to reduce the rotation of the drive panel 81 at a given ratio and then transmit the reduced rotation to a valve mechanism operation piece 88. The reducing ratio is selected as a value, for example, 6400 to 1, which makes it possible for a spring provided between the base member 25 and the operation piece 88 to retreat the operation piece 88 from a position opposed to the drive rod 54.

Next, description will be given below of the operation of the thus constructed device with reference to FIGS. 8, 9 and 10.

When the recording head 3 waits at the home position (a position i shown in FIG. 8), the cam follower 69 occupies the quasi-stable position P2 of the cam surface 65 to thereby raise the frame body 61 and also the drive rod 54 is pushed by the valve mechanism operation piece 88 to thereby close the air release port 13, so that the recording head 3 is hermetically sealed by the cap member 12 to prevent ink from being dried (See FIG. 9 (*a*)).

Figure 8:
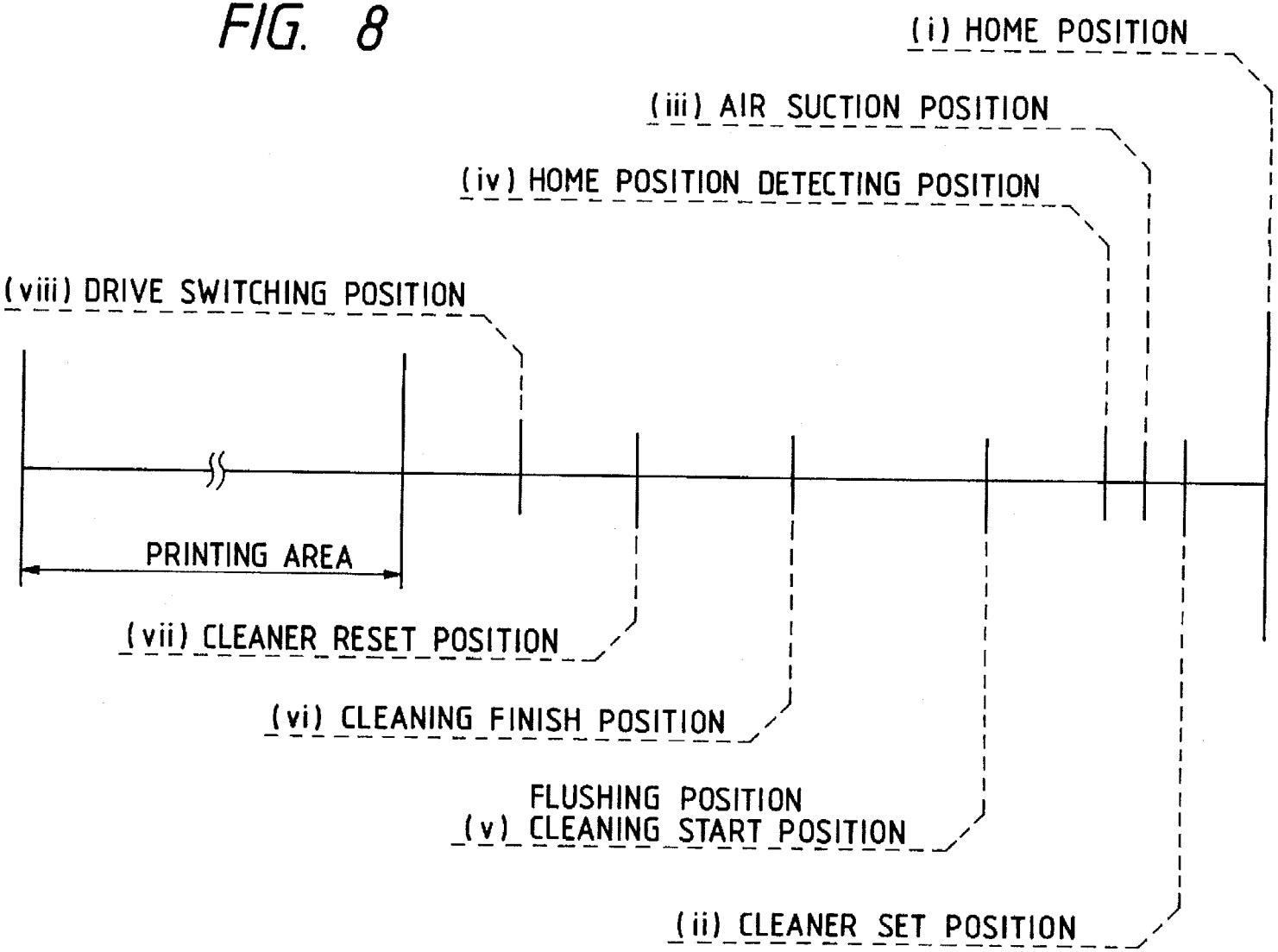
FIG. 8 is an explanatory diagram of a relation between the position of the recording head and the operations of the capping device and cleaning device.

In the waiting state, if the power supply turns on, then at first the carriage 1 is moved to the printing area side to thereby cause the recording head 3 to pass through a cleaner set position (a position ii shown in FIG. 8) and move to an air suction position (a position iii shown in FIG. 8). In this moving process, the slider 26 moves along the plane 25*b* and, therefore, the cap member 12 continues to seal the front surface of the recording head 3. At this position, the valve body 52 is retreated from the air release port 13 by the drive rod 54. After then, the paper feed motor 7 is rotated forwardly and the rotational movement of the paper feed motor 7 is transmitted through the ring array 6 to the suction pump 20, so that the drive panel 81 of the pump 20 is rotated in a direction of an arrow A shown in FIG. 7. The rotation of the drive panel 81 moves the rollers 82, 82 outwardly along the elongated grooves 81*b*, 81*b* to thereby rub the tube 21 and thus generate a negative pressure. In this condition, since the air release port 13 is open, waste ink possibly remaining in the absorber 47 and tube 21 can be discharged into the waste ink tank 22 without applying the negative pressure to the recording head 3. This can prevent air bubbles from entering the nozzle in the capping operation.

On the other hand, the rotation of the drive panel 81 of the pump 20 is transmitted to the differential gears 85, 86 and is then transmitted to the valve mechanism operation piece 88. In this state, because the accumulation operation time of the pump 20 is short, the valve mechanism operation piece 88 cannot be retreated from the contact area of the drive rod 54.

After completion of the suction for a given period of time, the carriage 1 is moved toward the printing area. The slider 26 follows the movement of the carriage 1 due to the energization forces of the springs 29 and 63 and moves along the plane 25*b* to the printing area. When it moves to a given position, then the slider 26 reaches the inclined surface 25*a* and thus it goes downward, which causes the cap member 12 to part from the front surface of the recording head 3. At a stage when the engagement between the cap member 12 and recording head 3 is removed completely, the carriage 1 inverts its moving direction and then moves toward outside the printing area. As a result of this, the cam follower 69 rises through the inclined surfaces 71, 72 and 73 (See FIG. 9 (*b*)). If the carriage 1 moves further and reaches the quasi-stable point P2, then the frame body 61 is raised up by the height H. Due to the raise of the frame body 61, the cleaning member 17 is also raised up and is set at a position where it can be contacted with the front surface of the recording head 3 (See FIG. 10 (*a*)). In this state, if the carriage 1 is further moved toward the printing area, then a rubber plate 17*a* is positioned upside and is abutted against the recording head 3, so that the vicinity of the nozzle opening of the recording head 2 is wiped to thereby remove ink droplets attached thereto due to suction or flushing.

Figure 11:
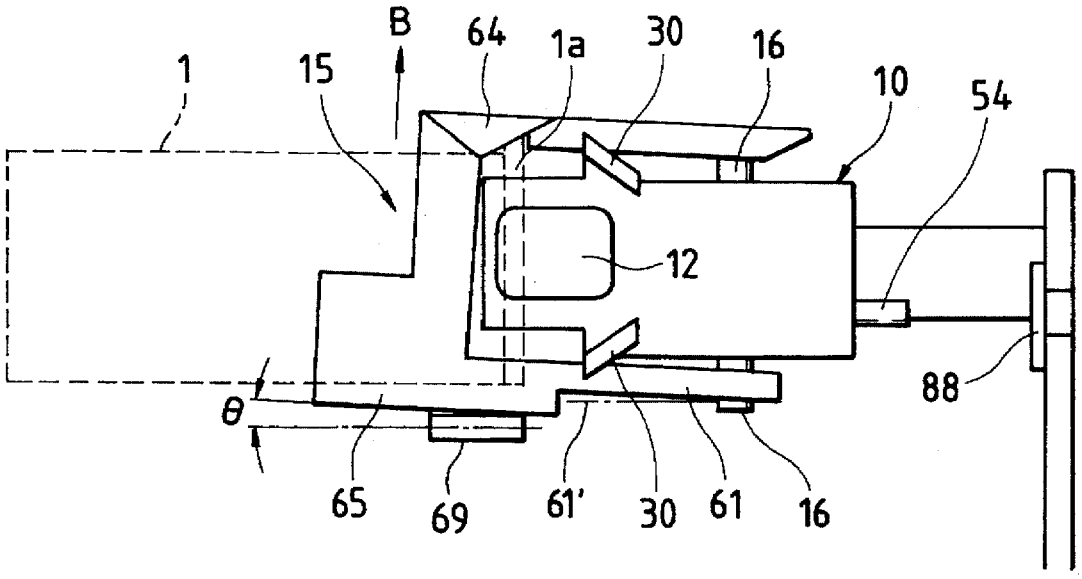
FIG. 11 is an explanatory view of the operation of a cleaning member support frame caused by a flag piece of a carriage.

In this manner, when the recording head 3 passes through the cleaning member 17 and then the flag piece 1*a* of the carriage 1 reaches the remove piece 64, then the remove piece 64 is pushed off outwardly by an angle of θ in a direction of an arrow B shown in FIG. 11 by the flag piece 1*a*, so that the cam surface 65 is caused to part from the cam follower 69 (see FIG. 11). This removes the support of the inclined surface 74 by the cam follower 69, the frame body 61 is moved down by the energization force of the bending spring 29, and the cleaning member 17 is caused to retreat from the passing surface of the recording head 3. When the recording head 3 moves further toward the printing area and passes through a drive switch position (a position viii shown in FIG. 8), then the paper feed motor 7 is rotated reversely to send out the recording paper to the printing area, so that the recording paper can be set in a printable state.

On the other hand, at a time when a printing operation in the printing area continues for a given period of time and an ink expelling recovery operation is required, the printing operation by the recording head 3 is temporarily stopped and the recording head 3 is moved toward the home position. In the process of movement to the home position, the flag piece 1*a* of the carriage 1 passes through the remove piece 64 and then the recording head 3 arrives at the guides 30, 30. The slider 26 is guided by the guides 30, 30 so that it is positioned at the center of the recording head 3. And, if the carriage 1 moves further and thus the flag piece la comes in contact with the engagement piece 31 so that the recording head 3 is positioned at a flushing position (a position shown by v in FIG. 8) while it is opposed to the cap member 12 at a given distance, then ink is expelled regardless of the printing signal from at least the nozzle openings of the recording head 3 that have not been used during the printing operation, thereby executing a flushing operation. That is, by means of the flushing operation, ink remaining in the nozzle openings not used during the printing process is discharged out into the cap member 12 to prevent the ink in the nozzle openings from increasing its viscosity.

After completion of the flushing operation, if the carriage 1 is moved again toward outside the printing area, then the slider 26 is moved upwardly along the inclined surface 25*a* in accordance with the movement of the recording head 3. And, at a time when the slider 26 is moved up to a position to allow capping and to allow the valve body 52 to retreat from the air release port 13 by use of the drive rod 54, that is, the air suction position (shown by iii in FIG. 8), the suction pump 20 is put into operation. As a result of this, the waste ink absorbed by the ink absorber 47 in the flushing operation can be discharged out into the waste ink tank 22. The rotation of the suction pump 20 in the ink discharge process is also transmitted to the differential gears 85, 85 and the number of operations thereof is accumulated.

On completion of the air suction, if the recording head 3 is moved toward the printing area, then the slider 26, as described before, is caused to follow the movement of the carriage 1 by the energization force of the spring 29 and is moved along the plane 25*b* to the printing area. When the slider 26 moves to a given position, then it arrives at the inclined surface 25*a* along which it is then moved downwardly, so that the cap member 12 is caused to part from the front surface of the recording head 3. At a stage where the engagement between the cap member 12 and recording head 3 is completely removed, the carriage 1 inverts its moving direction and then moves toward outside the printing area. This causes the cam follower 69 to move upwardly through the inclined surface 71, 72 and 73 (see FIG. 9 (*b*)). If the cam follower 69 moves further and arrives at the quasi-stable point P2, then the frame body 61 is lifted up by a height H. As the frame body 61 is lifted up, the cleaning member 17 is also lifted up and is set at a position where it can contact the front surface of the recording head 3 (see FIG. 10 (*a*)). In this state, if the carriage 1 is further moved toward the printing area, then it comes in contact with the recording head 3 with the blade member 17*a* positioned on the upper surface side thereof, so that the vicinity of the nozzle opening of the recording head 3 is wiped to thereby remove the ink droplets that are attached to the nozzle opening due to the flushing operation.

At a stage where the ink expelling ability is recovered in this manner, if printing data exists, then the carriage 1 is simply moved to the printing area.

On the other hand, if the printing data is absent and the device goes to its rest condition, then the carriage 1 is moved toward the wait position. As a result of the movement of the carriage 1, the slider 26 goes upwardly along the inclined surface 25*a* as the recording head 3 moves. If the slider 26 goes further toward outside the printing area, then the passing of the recording head 3 in this process can be detected by home position detect means (not shown). After a signal is output from the home position detect means, if the carriage 1 is further moved a given amount toward outside the printing area, that is, a deceleration distance necessary to decelerate from a given speed to stop, then the projection 27 of the slider 26 reaches the plane 25*b*, and the cap member 12 is elastically abutted against the front surface of the recording head 3. If the carriage 1 passes through the air suction position (a position shown by iii in FIG. 8) and the cleaner set position (a piston shown by ii in FIG. 8), then the drive rod 54 is abutted against the valve mechanism operation piece 88. In this state, the carriage 1 is caused to stop and is set at its wait position (a position shown by i in FIG. 8). In this state, the support by the guide rod 51 is removed and thus the air release port 13 is sealed by the valve body 52 due to the energization force of the spring 50, and the carriage 1 or the recording head 3 is prepared for the next printing operation in a condition where the drying of the ink in the nozzle opening is prevented.

Due to the fact that between the detect position (a position shown by iv in FIG. 8) of the recording position 3 to be detected by the home position detect means and the wait position (a position shown by i in FIG. 8) of the recording head 3 there is disposed an approach distance to decelerate at least the carriage, even if a carriage drive motor goes out of order during the printing operation in the printing area, the position of the recording head 3 can be detected by the home position detect means in a stage before it returns to the wait position and, therefore, it is possible to set again an accurate moving distance to the wait position with the home position detect position as a reference. As a result of this, the recording head 3 can be positioned at the wait position with accuracy and thus the cap member 12 can be positively abutted against the recording head 3.

Also, during the operation of the pump 20, if the carriage 1 is forcibly moved in error toward the printing area by an external force and is caused to pass through the drive switch position, a recording paper supply operation is started. However, according to the present embodiment, since the passing of the recording head 3 can be detected by the home position detect means in a stage before the carriage 1 arrives at the drive switch position (a position shown by viii in FIG. 8), the recording paper can be handled according to the position of the recording head 3, which makes it possible to prevent the recording paper from being loaded at the improper position of the recording head 3 and thus to prevent too many sheets of recording paper from being supplied together. Especially, as in the present embodiment, if there is employed a system in which the suction operation and the recording paper loading operation are executed by switching the direction of rotation of the same motor 7, then the reliability can be improved to a great extent.

When the ink flow path is altered by replacement of an old ink cartridge with a new one or by mounting a new head, a rubbing operation is required. In this case, the cleaning member 17 is raised according a procedure similar to the above-mentioned wiping operation and the recording head 3 is moved to the printing area. Then, the carriage 1 is moved in an opposite direction (a direction of an arrow C shown in FIG. 10 (*b*)) to the wiping operation. As a result of this, with the rubbing member 17*b* as the upper surface thereof, the cleaning member 17 is abutted against the front surface of the recording head 3.

When the amount of accumulation of the waste ink accumulated by the above-mentioned flushing operation and the forced suction of ink from the nozzle openings reaches the capacity of the waste ink tank 22, then the valve mechanism piece 88 is caused to retreat from the position of the drive rod 54 by the differential gears 85, 86 (a state shown by reference character 78' in FIG. 7). For this reason, even if the recording head 3 is capped, the drive rod 54 cannot be pressed by the valve mechanism operation piece 88. This allows the air release port 13 to be in communication with the air and thus there is eliminated the possibility that the negative pressure from the suction pump 20 can be increased up to a degree to be able to suck out ink from the recording head 3 forcibly. As a result of this, the waste ink is prevented from flowing over from the waste ink tank 22, which in turn makes it possible to prevent the interiors of a printer box from being contaminated and a circuit substrate from being short circuited.

In the above-mentioned embodiment, the remove piece is pressed by the carriage. However, it is obvious that a similar action can be provided even when the remove piece is pressed by the recording head.

As has been described heretofore, according to the present invention, there is provided an ink jet recording device that includes cap support means which is disposed out of a printing area and, when pushed by a carriage, can be moved between a non-capping position and a capping position, shift means which, in a process where a recording head is moved from the non-capping position to the capping position, displaces the cap support means, cleaning member support means which is swingably mounted to the cap support means and moves between a non-cleaning position and a cleaning position in accordance with the movement of the carriage, and suction means which supplies a negative pressure to the cap means to thereby suck out ink within a cap into a waste ink tank. According to this structure, the parts necessary for the capping operation and cleaning operation can be moved to and from a recording head moving path only by means of the movement of the carriage or recording head. This makes it possible to simplify and make compact drive means for an ink expelling ability keeping and recovering device.

What is claimed is:

1. An ink-jet recording device, comprising:

a recording head for expelling ink droplets onto recording paper in accordance with a printing signal;

paper feed means for moving the recording paper in a paper feed direction;

a carriage supporting said recording head, said recording head and said carriage being disposed for movement in a direction substantially perpendicular to the paper feed direction;

capping means for capping a nozzle opening surface of said recording head, including:

a cap member which contacts the nozzle opening surface of said recording head to seal the nozzle opening surface;

cap support means for supporting said cap member, said cap support means being disposed outside of a printing area of said recording head, said cap support means being disposed for movement between a non-capping position and a capping position in accordance with the movement of one of said carriage and said recording head; and shift means for shifting said cap support means to the nozzle opening surface of said recording head when one of said carriage and said recording head moves from one position corresponding to the non-capping position to another position corresponding to the capping position;

cleaning means for cleaning the recording head, including:

a cleaning member for rubbing a front surface of said recording head to thereby clean the front surface; and cleaning member support means for supporting said cleaning member and for moving said cleaning member between a non-cleaning position and a cleaning position in accordance with the movement of one of said carriage and said recording head, said cleaning member support means being movably disposed on said capping means for relative movement with respect to said capping means;

suction means for supplying a negative pressure to said cap member and for sucking waste ink from within said head through said cap member; and a waste ink tank for storing the waste ink sucked from within said cap member.

2. An ink-jet recording device as set forth in claim 1, wherein said cap support means comprises a slider disposed for movement in at least the paper feed direction and the direction substantially perpendicular to the paper feed direction, and wherein said shift means comprises a projection as part of said slider, said projection riding over an inclined surface and a substantially planar surface of a base member to move said slider and said cap member into the capping and non-capping positions.

3. An ink-jet recording device as set forth in claim 2, wherein one of said carriage and said recording head include a flag piece, and wherein said slider includes a engagement piece which is contacted by said flag piece to move said slider and said cap member into the capping and non-capping positions.

4. An ink-jet recording device as set forth in claim 1, wherein said cap member and said suction means are in fluid connection via a connecting hole formed in said cap support means.

5. An ink-jet recording device as set forth in claim 1, wherein said cap support means is biased towards both the capping and the non-capping positions by a bending spring.

6. An ink-jet recording device as set forth in claim 1, wherein said cap member is connected to an air release port through a valve mechanism incorporated in said cap support means, and wherein said air release port is opened and closed by said valve mechanism and is operable in accordance with the movement of one of said recording head and said carriage.

7. An ink-jet recording device as set forth in claim 6, wherein said valve mechanism includes:

a guide rod having a valve body for sealing said air release port and an engagement portion, said guide rod being normally urged by a spring in a direction towards said air release port; and a drive rod for releasing said engagement portion in accordance with the movement of one of said carriage and said recording head so that said valve body seals said air release port.

8. An ink-jet recording device as set forth in claim 1, wherein said cleaning member support means is movably mounted on said capping means and disposed for movement about a point in a horizontal direction perpendicular to a moving path of said recording head as well as in a vertical direction substantially parallel to the paper feed direction, said cleaning member support means including a cam surface which is contacted with and detached from a cam follower on one side thereof and a remove piece on the other side thereof so that said cam surface and said remove piece face each other through said recording head moving path, said cleaning member support means retreating to the non-cleaning position when one of said carriage and said recording head contacts said remove piece.

9. An ink-jet type recording device as set forth in claim 1, wherein said suction means includes a peristaltic pump having a pair of rollers spaced apart from each other, a tube having an outer peripheral surface that is contacted by said rollers, a drive plate to which said rollers are movably mounted, and a slide plate in the vicinity of said drive plate and said tube, having a coefficient of friction less than the coefficient of friction of said drive plate, for reducing friction between said tube and said drive plate.

10. An ink-jet recording device as set forth in claim 9, wherein said suction means includes a reduction mechanism which operates a valve mechanism drive piece to keep said valve mechanism in an air released condition when said waste ink tank is filled to a predetermined level.

11. An ink-jet recording device as set forth in claim 1, wherein said cleaning member support means includes a cam surface which is contacted with and detached from a cam follower so that said cam surface faces one side of said recording head moving path, and wherein said cam surface includes an inclined surface which, in accordance with the movement of one of said carriage and said recording head, guides said cleaning member support means so that said cleaning member is moved to the cleaning position, and another inclined surface which, in accordance with the movement of one of said carriage and said recording head, guides said cleaning member support means so that said cleaning member is moved to the non-cleaning position.

12. An ink-jet recording device, comprising:

a recording head for expelling ink droplets onto recording paper in accordance with a printing signal;

a cap member for capping a nozzle opening surface of said recording head to seal the nozzle opening surface, said cap member connected to an air release port through a valve mechanism;

a waste ink;

suction means for supplying a negative pressure to said head through said cap member and for sucking out said waste ink from said head through said cap member into said waste ink tank; and ink suction stopping means for opening the air release port by said valve mechanism to stop the negative pressure supply when an amount of the waste ink in said waste ink tank reaches a predetermined value.

13. An ink-jet recording device, comprising:

a recording head for expelling ink droplets onto recording paper in accordance with a printing signal;

paper feed means for moving the recording paper in a paper feed direction;

a carriage supporting said recording head, said recording head and said carriage being disposed for movement in a direction substantially perpendicular to the paper feed direction;

capping means for capping a nozzle opening surface of said recording head, including:

a cap member which contacts the nozzle opening surface of said recording head to seal the nozzle opening surface;

cap support means for supporting said cap member, said cap support means being disposed outside of a printing area of said recording head, said cap support means being disposed for movement between a non-capping position and a capping position in accordance with the movement of one of said carriage and said recording head; and shift means for shifting said cap support means to the nozzle opening surface of said recording head when one of said carriage and said recording head moves from one position corresponding to the non-capping position to another position corresponding to the capping position;

cleaning means for cleaning the recording head, including:

a cleaning member for rubbing a front surface of said recording head to thereby clean the front surface; and cleaning member support means for supporting said cleaning member and for moving said cleaning member between a non-cleaning position and a cleaning position in accordance with the movement of one of said carriage and said recording head, said cleaning member support means being movably disposed on said capping means;

suction means for supplying a negative pressure to said head through said cap member and for sucking waste ink from within said cap member; and a waste ink tank for storing the waste ink sucked from within said head through said cap member, wherein said cap member is connected to an air release port through a valve mechanism incorporated in said cap support means, and wherein said air release port is opened and closed by said valve mechanism and is operable in accordance with the movement of one of said recording head and said carriage, and wherein said valve mechanism includes:

a guide rod having a valve body for sealing said air release port and an engagement portion, said guide rod being normally urged by a spring in a direction towards said air release port; and a drive rod for releasing said engagement portion in accordance with the movement of one of said carriage and said recording head so that said valve body seals said air release port.

14. An ink-jet recording device, comprising:

a recording head for expelling ink droplets onto recording paper in accordance with a printing signal;

paper feed means for moving the recording paper in a paper feed direction;

a carriage supporting said recording head, said recording head and said carriage being disposed for movement in a direction substantially perpendicular to the paper feed direction;

capping means for capping a nozzle opening surface of said recording head, including:

a cap member which contacts the nozzle opening surface of said recording head to seal the nozzle opening surface;

cap support means for supporting said cap member, said cap support means being disposed outside of a printing area of said recording head, said cap support means being disposed for movement between a non-capping position and a capping position in accordance with the movement of one of said carriage and said recording head; and shift means for shifting said cap support means to the nozzle opening surface of said recording head when one of said carriage and said recording head moves from one position corresponding to the non-capping position to another position corresponding to the capping position;

cleaning means for cleaning the recording head, including:

a cleaning member for rubbing a front surface of said recording head to thereby clean the front surface; and cleaning member support means for supporting said cleaning member and for moving said cleaning member between a non-cleaning position and a cleaning position in accordance with the movement of one of said carriage and said recording head, said cleaning member support means being movably disposed on said capping means;

suction means for supplying a negative pressure to said head through said cap member and for sucking waste ink from within said cap member; and a waste ink tank for storing the waste ink sucked from within said head through said cap member, wherein said cleaning member support means is movably mounted on said capping means and disposed for movement about a point in a horizontal direction perpendicular to a moving path of said recording head as well as in a vertical direction substantially parallel to the paper feed direction, said cleaning member support means including a cam surface which is contacted with and detached from a cam follower on one side thereof and a remove piece on the other side thereof so that said cam surface and said remove piece face each other through said recording head moving path, said cleaning member support means retreating to the non-cleaning position when one of said carriage and said recording head contacts said remove piece.

15. An ink-jet recording device, comprising:

a recording head for expelling ink droplets onto recording paper in accordance with a printing signal;

paper feed means for moving the recording paper in a paper feed direction;

a carriage supporting said recording head, said recording head and said carriage being disposed for movement in a direction substantially perpendicular to the paper feed direction;

capping means for capping a nozzle opening surface of said recording head, including:

a cap member which contacts the nozzle opening surface of said recording head to seal the nozzle opening surface;

cap support means for supporting said cap member, said cap support means being disposed outside of a printing area of said recording head, said cap support means being disposed for movement between a non-capping position and a capping position in accordance with the movement of one of said carriage and said recording head; and shift means for shifting said cap support means to the nozzle opening surface of said recording head when one of said carriage and said recording head moves from one position corresponding to the non-capping position to another position corresponding to the capping position;

cleaning means for cleaning the recording head, including:

a cleaning member for rubbing a front surface of said recording head to thereby clean the front surface; and cleaning member support means for supporting said cleaning member and for moving said cleaning member between a non-cleaning position and a cleaning position in accordance with the movement of one of said carriage and said recording head, said cleaning member support means being movably disposed on said capping means;

suction means for supplying a negative pressure to said head through said cap member and for sucking waste ink from within said recording head; and a waste ink tank for storing the waste ink sucked from within said head through said cap member, wherein said suction means includes a peristaltic pump having a pair of rollers spaced apart from each other, a tube having an outer peripheral surface that is contacted by said rollers, a drive plate to which said rollers are movably mounted, and a slide plate in the vicinity of said drive plate and said tube, having a coefficient of friction less than the coefficient of friction of said drive plate, for reducing friction between said tube and said drive plate.

16. An ink-jet recording device as set forth in claim 15, wherein said suction means includes a reduction mechanism which, at a stage where a sucking operation to suck waste ink in an amount corresponding to a preset volume of said waste ink tank has been executed, operates a valve mechanism drive piece to keep said valve mechanism in an air released condition.

17. An ink-jet recording device as set forth in any one of claims 13–15, wherein said support means comprises a slider disposed for movement in at least the paper feed direction and the direction perpendicular to the paper feed direction, and wherein the shift means comprises a projection as part of said slider, said projection riding over an inclined surface and a substantially planar surface of a base member to move said slider and said cap member into the capping and non-capping positions.

18. An ink-jet recording device as set forth in any one of claims 13–15, wherein said cap member and said suction means are connected to each other through a connecting hole formed in said cap support means.

19. An ink-jet recording device as set forth in any one of claims 13–15, wherein said cap support means is biased towards the capping and non-capping positions by a bending spring.

20. An ink-jet recording device as set forth in any one of claims 13–15, wherein one of said carriage and said recording head include a flag piece, and wherein said slider includes a engagement piece which is contacted by said flag piece to move said slider and said cap member into the capping and non-capping positions.

21. An ink jet recording apparatus, comprising:

means for producing a print signal;

a recording head communicating via an ink supply member with an ink tank and being responsive to a print signal for ejecting ink drops from nozzle openings to recording paper;

capping means abutting against a front of said recording head for closing the nozzle openings in an airtight state, said capping means comprising an atmospheric opening;

a valve mechanism for opening and closing said atmospheric opening of said capping means, said valve mechanism comprising a sliding means and a valve body mounted on said sliding means and sliding therewith, said valve body opening and closing said atmospheric opening of said capping means in accordance with the movement of said sliding means; and suction means for supplying negative pressure to said capping means and sucking ink from said recording head through said capping means into a waste ink holding means.

* * * * *